US007163466B1

(12) United States Patent
Downey

(10) Patent No.: US 7,163,466 B1
(45) Date of Patent: Jan. 16, 2007

(54) GOLF CLUB GRIP WITH EMBEDDED DISPLAY AND METHOD OF FABRICATION

(76) Inventor: Philip L. Downey, 5867 Jasmine St., Riverside, CA (US) 92504

( * ) Notice: Subject to any disclaimer, the term of this patent is extended or adjusted under 35 U.S.C. 154(b) by 0 days.

(21) Appl. No.: 11/185,323

(22) Filed: Jul. 21, 2005

(51) Int. Cl.
*A63B 53/14* (2006.01)

(52) U.S. Cl. ..... 473/300

(58) Field of Classification Search ..... 473/300–303, 473/549–552, 201, 203, 568; D21/756; D8/DIG. 6–8; 74/551.9; 280/821; 81/489, 492; 16/421, 16/430, DIG. 12, 18, DIG. 19
See application file for complete search history.

(56) References Cited

U.S. PATENT DOCUMENTS

| | | | | |
|---|---|---|---|---|
| 1,139,843 | A | 5/1915 | Brown | |
| 1,626,967 | A | 5/1927 | Reach | |
| 1,994,556 | A | 3/1935 | Winters | |
| 2,103,889 | A | 12/1937 | Brisick | |
| 4,416,166 | A | 11/1983 | Jannard et al. | |
| 4,662,415 | A | 5/1987 | Proutt | |
| 4,819,939 | A | 4/1989 | Kobayashi | |
| 4,919,420 | A | 4/1990 | Sato | |
| 4,934,024 | A | 6/1990 | Sexton | |
| 4,953,862 | A | 9/1990 | Uke et al. | |
| 5,261,665 | A | 11/1993 | Downey | |
| 6,122,802 | A * | 9/2000 | Lo | 16/431 |
| 6,503,430 | B1 | 1/2003 | Downey | |
| 6,581,247 | B1 * | 6/2003 | Yu Chen | 16/430 |
| 6,790,029 | B1 | 9/2004 | Downey | |

FOREIGN PATENT DOCUMENTS

| | | | |
|---|---|---|---|
| GB | 2 133 340 | A | 7/1984 |
| GB | 2 182 252 | A | 5/1987 |
| GB | 2 192 550 | A | 1/1988 |
| GB | 2 251 801 | A | 7/1992 |

OTHER PUBLICATIONS

KRATON Thermoplastic Rubber, Typical Properties 1986, Shell Chemical Company, 8 pages.

* cited by examiner

*Primary Examiner*—Stephen Blau
(74) *Attorney, Agent, or Firm*—Charles H. Thomas

(57) ABSTRACT

An improved construction for a grip, such as a golf club grip, employs interchangeable placards that may be utilized upon identical sockets formed in a first mold. The placards are constructed with at least one, and preferably a plurality, of raised displays, such as display symbols in the form of letters, numbers, geometric designs, and other display figures. Any number of different placards may alternatively be mounted upon a socket to produce a grip according to the present invention. The socket and placard are positioned by means of positioning pegs on the underside of the mounting base of the placard. The positioning pegs are inserted into corresponding locator openings in the wall of the socket. The socket, together with the placard mounted thereon, is positioned in a second mold having a mold cavity larger than the mold cavity of the first mold in which the socket is produced. The second mold is configured so that the display face or faces of the displays projecting out from the upper surface of the placard reside in contact with the inner molding surface of the second mold. A second charge of molten material is injected into the second mold, thereby forming a jacket that encapsulates the socket, covers the mounting base of the placard, and surrounds all of the raised displays on the placard. However, the display faces of the raised displays of the placard remain exposed.

20 Claims, 6 Drawing Sheets

GOLF CLUB GRIP WITH EMBEDDED DISPLAY AND METHOD OF FABRICATION

BACKGROUND OF THE INVENTION

1. Field of the Invention

The present invention relates to an improved grip for an implement having a handle, and the method of manufacture of such a grip. The invention has particular utility in the manufacture of golf club grips.

2. Description of the Prior Art

Golf club grips and grips for other implements have a wide variety of different constructions and have been fabricated in different ways over the years. The shaft of a golf club is an elongated, narrow, generally cylindrical structure which may be formed of solid wood, a solid metal rod, or hollow metal tubing, closed at the end remote from the golf club head. The extremity of the shaft of the golf club remote from the head serves as a handle, and is usually no more than about five-eighths of an inch in diameter. The golf club shaft is typically quite smooth, so that a grip of some type on the handle end is essential to allow a golfer to control the swing of the club.

Conventional golf club grips are formed as hollow, elongated structures, often of a molded thermoplastic material. Golf club grips have an open end into which the handle is inserted, and an opposite end which is largely capped, but which usually has a small aperture therein to allow entrapped air to escape when the grip is pressed onto the golf club shaft handle.

Very frequently golf club manufacturers desire to have the name of their companies, or a trademark of other brand name emblazoned on the golf club grip. In the conventional fabrication of a golf club grip the desired indicia or other display is often painted on the outer, exposed surface of the grip. However, with use, portions of the paint very typically flake off so that the portion remaining presents an unsightly, unflattering appearance.

A need has existed for golf club grips in which surface displays will not wear off and become unsightly. My prior U.S. Pat. No. 5,261,665, hereby incorporated by reference in its entirety, discloses a system in which a golf club grip is formed in steps from sequential molded charges of thermoplastic materials having contrasting colors in which an inner socket is provided with an overlying outer jacket. The socket and jacket are formed of different charges of a thermoplastic, and the socket has a plurality of outwardly projecting portions that are laterally surrounded by the structure of the jacket, but which have exposed, display faces. During the molding process the display faces of the outwardly projecting portions of the inner socket structure reside in contact with the inner surface of the mold forming the overlying jacket. Consequently, the charge of thermoplastic material that forms the jacket, while laterally surrounding the projections from the inner socket, does not cover the display faces of the projections.

Golf club grips and other grips constructed in this manner can have mold configurations for the socket that produce any number of different display indicia that project through the jacket into which the socket is molded. Consequently, a wide variety of different displays can be produced utilizing the feature of my prior U.S. Pat. No. 5,261,665.

Golf club grips formed according to this prior patent are superior to golf club grips that have painted display indicia on their surfaces in that the color of the inner socket, including the outwardly directed projections, contrasts with the color of the jacket. As a consequence, letters, numbers, designs, and other displays can be provided on a such a grip and will not wear off or otherwise deteriorate with usage and with the passage of time.

However, even though the system produces a very superior product, there are certain manufacturing difficulties. Specifically, in this prior system a unique, separate mold is required to produce each socket having outwardly projecting display protrusions. Thus, while the same system can be utilized to produce comparable golf club grips for different manufacturers, wherein the name or trademark of each manufacturer is visible as a display, a separate mold is required for each different socket for each different manufacturer. Thus, to produce grips for a plurality of different manufacturers, a corresponding number of separate, unique socket molds are required.

Furthermore, in manufacturing grips for different manufacturers, the mold set up must be changed each time a run of grips for a different golf club manufacturer is to be produced. Changing of the molds is time consuming, as there are inevitably delays in adjusting and fine tuning the molding machinery each time a different socket mold is installed into the molding apparatus. The resulting downtime of the molding machinery increases the cost of production.

Furthermore, while the system of prior U.S. Pat. No. 5,261,665 is quite suitable for producing relatively large display features, it is incapable of producing displays having fine detail. That is, while complex figures and small numbers and letters can be painted on a golf club grip, it is quite difficult to fabricate a mold with projections that will produce fine detail on the surface of the grip.

SUMMARY OF THE INVENTION

The present invention provides a unique system for producing implement grips that have display features that will not deteriorate with use or passage of time, but which do not require a separate, different, intricate mold for each different display required. Furthermore, the molding system of the present invention is able to produce intricate display features without requiring complex molds to produce outward protrusions on the grip sockets that correspond to the intricate display features desired.

One very advantageous feature of the present invention is that the same molds can be utilized to form grips with inner sockets and outer jackets bonded thereto which have a wide variety of unique, embedded, surface display features. That is, the same molds can be utilized to produce grips for any number of different manufacturers or variations of grips having different display features.

A further very important advantage of the invention is that limited runs of grips having different display features can be performed and alternated with runs of grips having other display features without the lengthy mold down time and lost production time that would otherwise be required to produce grips having different display features. To the contrary, by the utilization of different placards having different raised displays formed thereon, changes in the display features may be accomplished utilizing the same mold equipment with different, unique placards incorporated in the grip structure.

A further very advantageous feature of the invention is that very fine detail in mold display features can be achieved by embedding placards containing the fine detail required from a common set of molds, without the necessity for constructing intricate socket molds for each different display desired.

In one broad aspect the present invention may be considered to be an implement grip having a hollow inner socket, a placard, and a jacket that encapsulates the socket and portions of the placard. The socket is a hollow structure having inner and outer surfaces and formed of a thermoplastic material having an open end for receiving a handle of an implement and an opposite end. The socket has a wall structure with a plurality of locating apertures defined in the outer surface of the wall. The placard is formed with a mounting base having inner and outer surfaces and with flow openings defined therethrough. The placard includes at least one raised display projecting from its outer surface. The display has an outer face. The placard further includes a plurality of positioning pegs projecting from the inner surface of the mounting base. The positioning pegs are inserted into the locating apertures in the socket. In this way the placard is mounted on the outer surface of the socket. The jacket is formed with an outer surface of a thermoplastic material molded upon the socket and encapsulating the mounting base of the placard. The jacket laterally surrounds the display. In this way the mounting base is totally concealed and the display is laterally surrounded by the jacket while the display face is exposed at the outer surface of the jacket.

In a primary application of the invention the implement grip is configured as a golf club grip in which the socket, the placard, and the jacket are all elongated structures. The mounting base of the placard is preferably a stiff, plastic, open framework and comprises a plurality of displays, such as a plurality of letters forming a trademark, brand name, or logo. Preferably, at least some of the displays of the placard are configured as raised, alpha-numeric characters. All of the displays on the placard project the same distance from the base.

The alpha-numeric characters, and other display features, can even be formed with laterally closing loops. The total encirclement of enclosed spaces is not possible in conventional molded grips, even utilizing the system of U.S. Pat. No. 5,261,665. This is because there is no flow path to encircled areas in conventional molding systems.

In another broad aspect the invention may be considered to be a method of manufacturing a grip for an implement. The method is comprised of several steps. First, a hollow socket with a plurality of locator apertures is molded on a mandrel in a first mold from a first charge of molten material. A placard is then mounted upon the socket. The placard is formed with a mounting base having inner and outer surfaces and with flow openings defined therethrough. The placard includes at least one raised display projecting from the outer surface of the base. Usually, a plurality of displays are provided. A plurality of positioning pegs projecting from the inner surface of the base are also provided on the placard. According to the invention, the positioning pegs of the placard are inserted into the locator apertures of the socket, once the socket has been formed. Thereafter, a jacket is molded about the socket in a second mold from a second charge of molten material. In this way the jacket envelops the socket and the base of the placard and laterally surrounds the raised display or displays on the placard. Nevertheless, the jacket leaves the display face or display faces on the placard exposed for observation.

The second, outer mold that is used to mold the jacket has an inner molding surface. Each display face of the placard is pressed against the inner molding surface of the second mold during molding of the jacket.

Typically, the placard will include not just a single display, but a plurality of raised displays of the type described. All of the display faces of the different displays project a uniform distance from the base of the placard so that they all contact the inner surface of the second mold.

Since the placard is formed with flow openings defined through the mounting base, portions of the second charge of material used to create the jacket for the grip are forced through the flow openings in the mounting base of the placard. Areas that are completely encircled by the displays can thereby be filled from beneath by the second charge of material forced up through the flow openings in the mounting base.

To form the locator apertures in the socket, the first mold has an interior wall surrounding a mold cavity, and positioning pins that project into the mold cavity from the interior wall of the first mold. The positioning pins, preferably, but not necessarily, extend far enough into the first mold to contact the mandrel. When the first mold is formed in this manner, the locating apertures formed in the hollow, inner socket extend all the way through the socket wall.

Because the placard is formed with a base having flow openings defined therethrough, molten, thermoplastic material can be forced in underneath the base of the placard and outwardly through the flow apertures so as to fill spaces defining vary intricate patterns. Very intricate design features can thereby be formed in the grip of the invention. That is, the second charge of molten material concurrently presses the display faces of the raised displays outwardly against the inner mold surface of the second mold during molding of the jacket while it fills all cavities in the second mold. The positioning pins on the interior wall of the first mold project into the mold cavity to form the locator apertures in the outer surface of the socket.

Preferably, both the first and second charges are formed of thermoplastic materials. Preferably also, they are different colors of thermoplastic rubber.

The placard is preferably formed with a mounting base configured as an elongated lattice with flow openings defined therethrough. The placard usually has a plurality of discrete displays, such as separated letters and/or numbers. These several displays are molded atop the lattice. Each of the displays resides atop a separate one of the flow openings in the placard base, but without completely blocking flow through the lattice openings.

In another broad aspect the invention may be considered to be a method of manufacturing a grip for an implement, for example a golf club grip. The method of the invention is comprised of the steps of molding a hollow socket, mounting a placard upon the socket, and molding a jacket about the socket and placard. Molding of the socket is performed by positioning a mandrel in a first mold. The hollow socket is molded from a first charge of molten material. The first mold in constructed so that a plurality of locator apertures are formed on the socket. The placard is formed with a mounting base having inner and outer surfaces and with flow openings defined through the mounting base. The placard includes at least one raised display projecting from the outer surface of the base and a plurality of positioning pegs projecting from the inner surface of the base. The placard is mounted by inserting the positioning pegs of the placard into the locator apertures of the socket. The jacket is molded about the socket in a second mold from a second charge of molten material. The jacket envelopes the socket and the base of the placard and laterally surrounds the display, or plurality of displays, leaving the display face or display faces exposed.

The invention may be described with greater clarity and particularity by reference to the accompanying drawings.

DESCRIPTION OF THE EMBODIMENT AND IMPLEMENTATION OF THE METHOD

Figure 1:
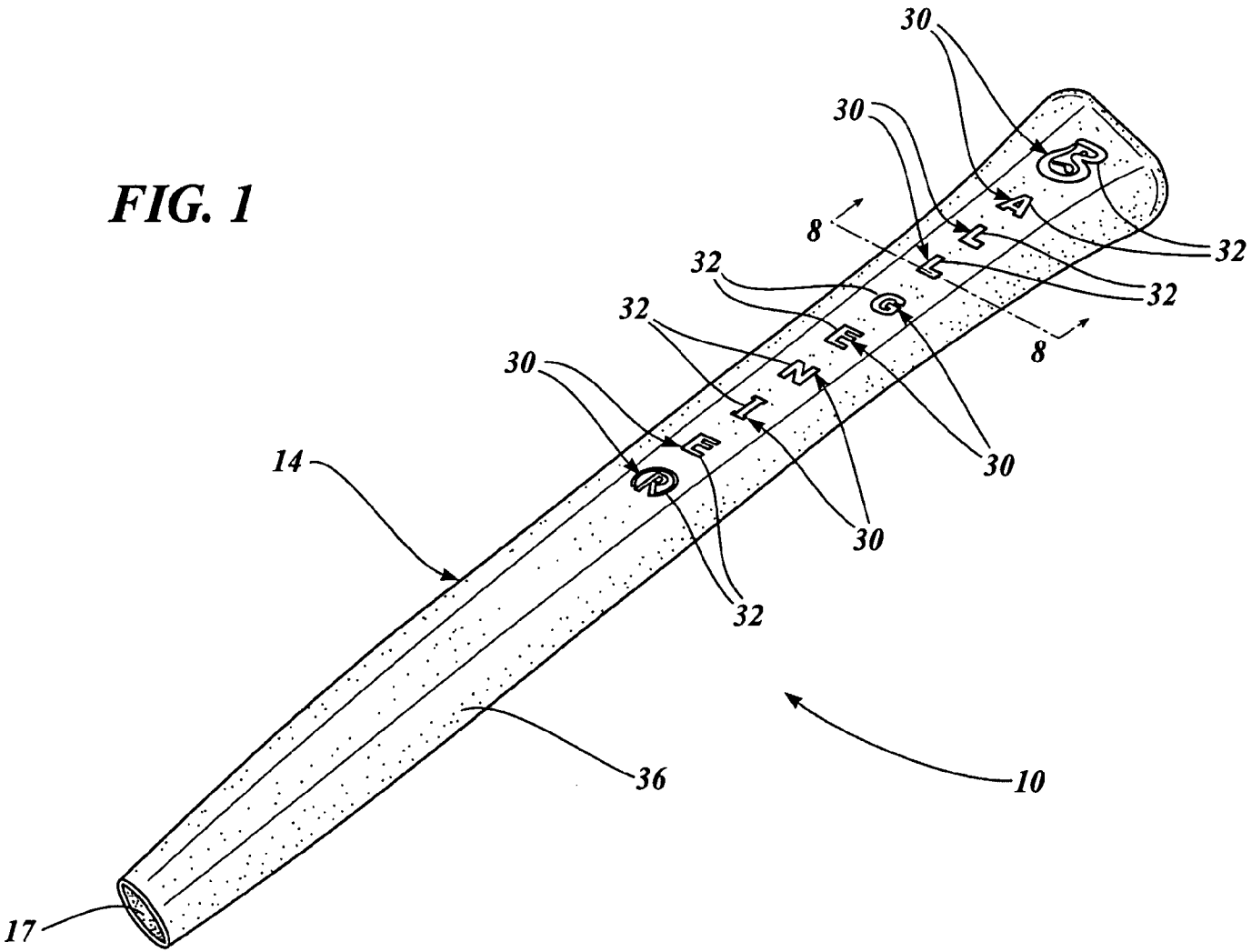
FIG. 1 is a perspective view illustrating a golf club grip constructed according to the present invention.
Figure 2:
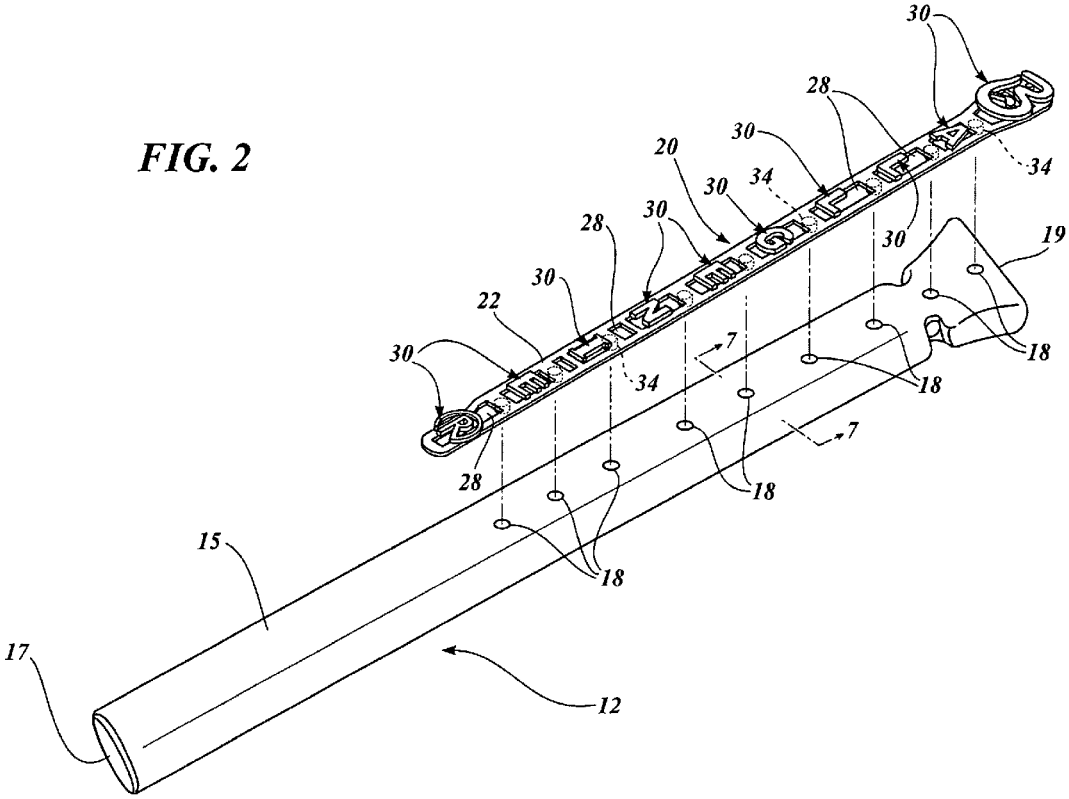
FIG. 2 is an exploded, perspective view of the socket and placard employed in the golf club grip of FIG. 1.
Figure 7:
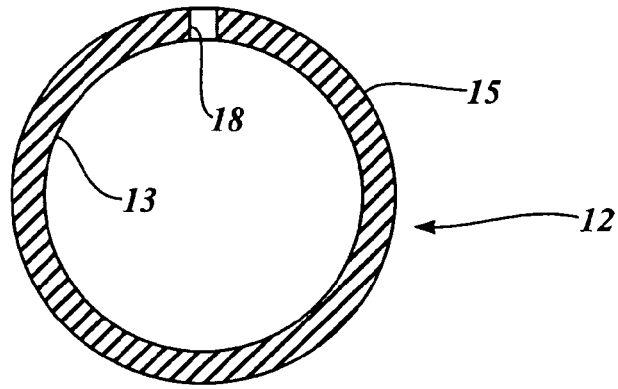
FIG. 7 is a sectional elevational detail of the socket, shown in isolation, and taken along the lines 7—7 of FIG. 2.

FIG. 1 illustrates a completed golf club grip 10 constructed according to the invention. The golf club grip 10 is comprised of a hollow, inner, tubular socket 12 which is best illustrated in FIGS. 2 and 7. The hollow, inner socket 12 has an inner surface 13 and an outer surface 15. The socket 12 has an open end 17 for receiving a handle of an implement, such as the handle of a golf club shaft, and an opposite end 19. The tubular socket 12 has a wall structure with a plurality of locating apertures 18 defined therein. The locating apertures are preferably linearly aligned with each other along a line parallel to the axis of the grip.

The golf club grip 10 also includes a placard 20 which is formed with a mounting base 22 having an inner surface 24 and an outer surface 26. Flow openings 28 are defined through the structure of the placard base 22.

Figure 9:
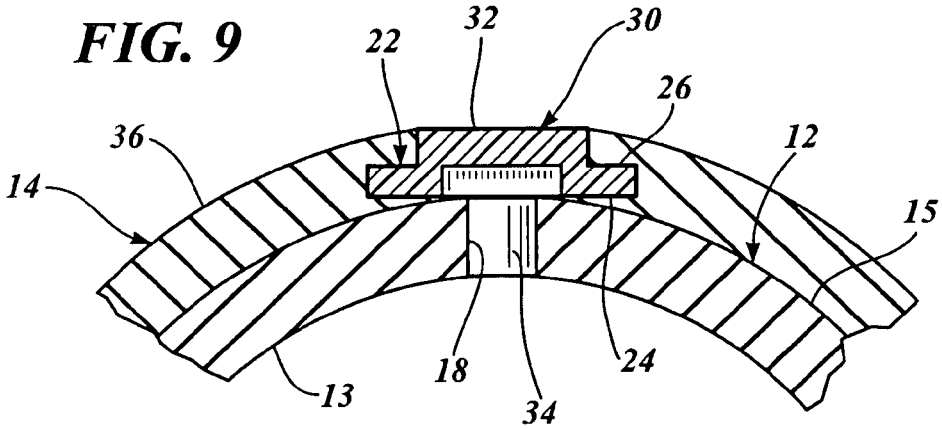
FIG. 9 is an enlarged detail of a portion of FIG. 8.

The placard 20 includes at least one, and preferably a plurality of raised displays 30 in the form of raised letters or other symbolic characters. In the embodiment illustrated the display characters are the letters "B", "A", "L", "L", "G", "E", "N", "I", "E", and the trademark registration symbol "®". The raised display letters and symbols 30 project from the outer surface 26 of the placard base 22, as best illustrated in FIG. 9. Each of the display characters 30 has a flat outer display face 32.

Figure 8:
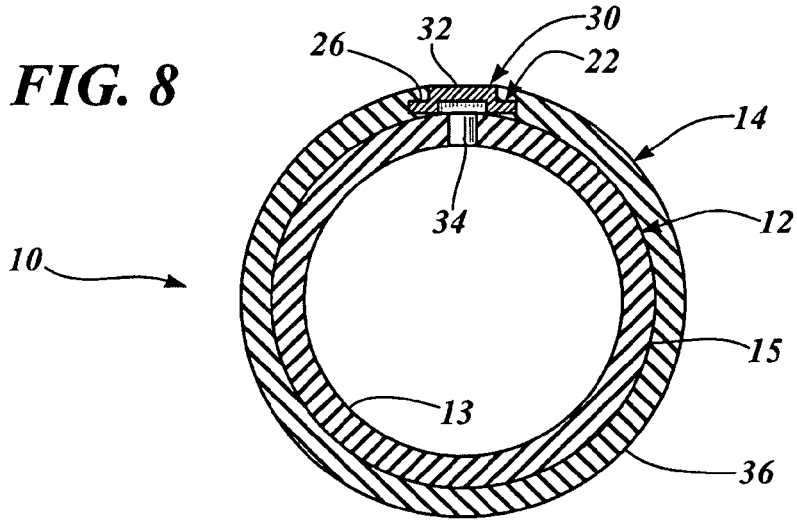
FIG. 8 is a sectional elevational detail of the golf club grip of the invention taken along the lines 8—8 of FIG. 1.

The placard 20 further includes a plurality of positioning pegs 34 that project from the inner surface 24 of the mounting base 22 at longitudinally spaced intervals from each other. As illustrated in FIGS. 2, 8, and 9, the positioning pegs 34 project from the inner surface 24 of the mounting base 22 and are inserted into the locating apertures 18 in the socket 12. In this way the placard 20 can be mounted on the outer surface 15 of the socket 12, and will remain in position thereon, as indicated in FIGS. 2, 8, and 9.

The golf club grip 10 is further comprised of a jacket 14 that has an outer surface 36. The jacket 14 is formed of a thermoplastic material that has a color that contrasts with the color of the placard 30. The jacket 14 is molded upon the socket 12 and encapsulates the mounting base 22 of the placard 20, as illustrated in FIGS. 8 and 9. As also shown in those drawing figures, the jacket 14 laterally surrounds the raised display characters 30. The placard mounting base 22 is thereby totally concealed from view in the finished golf club grip 10, as is evident in FIG. 1. However, as shown in that drawing figure, all of the display faces 32 of the display symbols 30 are fully exposed at the outer surface 36 of the jacket 14.

Because the golf club grip 10 is configured to receive the end extremity of a golf club shaft remote from the head in the circular socket opening 17, the socket 12, the placard 20, and the jacket 14 are all formed as longitudinally elongated structures. The placard 20 is formed as a molded structure from a stiff, plastic material having a color different from the color of the jacket 14.

Figure 3:
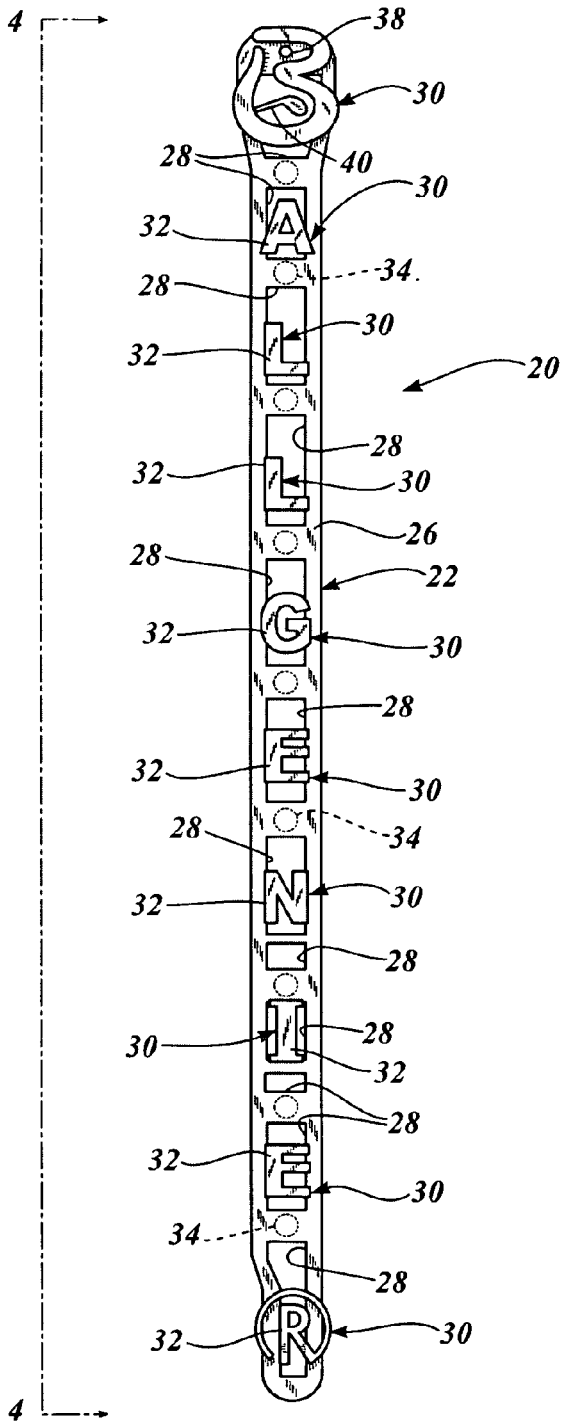
FIG. 3 is a front elevational view of the placard employed in the golf club grip of FIG. 1.

As illustrated in FIG. 3, the mounting base 22 is an elongated open lattice framework comprising the plurality of display characters 30. At least some, and in fact nearly all, of the display symbols 30 are configured as raised, alpha-numeric characters, all projecting the same distance out from the outer surface 26 of the placard base 22. Also as illustrated in FIG. 3, at least some of the alpha-numeric character displays 30 are formed with laterally enclosing loops. That is, for example, the raised letters "B", "A", "G", and the registration symbol "®" are formed with laterally enclosing loops surrounding areas that are either totally or to a large extent surrounded by the surrounding raised structure of the display character 30.

Figure 4:
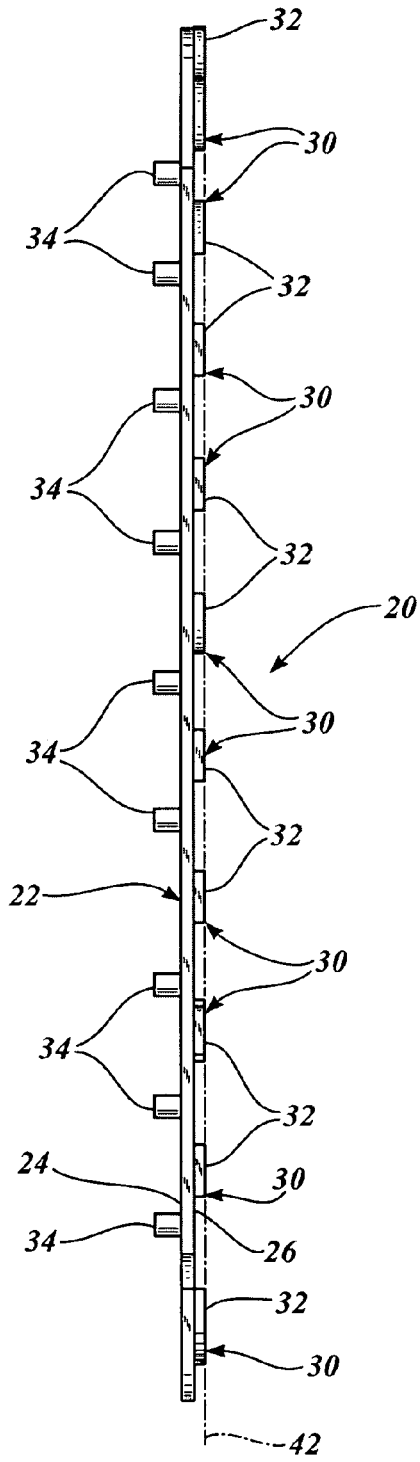
FIG. 4 is a side elevational view of the placard shown in FIG. 3.

As also noted, the placard 20 may include raised displays having very fine detail. For example, the display 30 forming the first letter "B" at the top of the placard 20 includes a small, raised post 38, the exposed circular surface of which simulates a golf ball in the upper, laterally enclosed loop of the letter "B". Likewise, there is a simulation of a small golf club head formed at 40 within the lower loop of the letter "B". As indicated in FIG. 4, all of the surfaces 32 of the displays 30 are located at the same, uniform distance from the upper surface 26 of the placard base 22. In the embodiment illustrated, all of the display faces 32 of the displays 30 reside in the same, common plane indicated at 42 in FIG. 4.

In the embodiment of the invention illustrated, many of the flow openings 28 are formed with a generally rectangular shape. The raised characters 30 are preferably formed so as to span the flow openings 28, whereby there is a path of fluid flow up from the underside 24 of the mounting base 22, through the flow openings 28, into the enclosed loops of the characters 30 that have enclosed loops, and laterally around the outlines of all of the characters 30.

Figure 5:
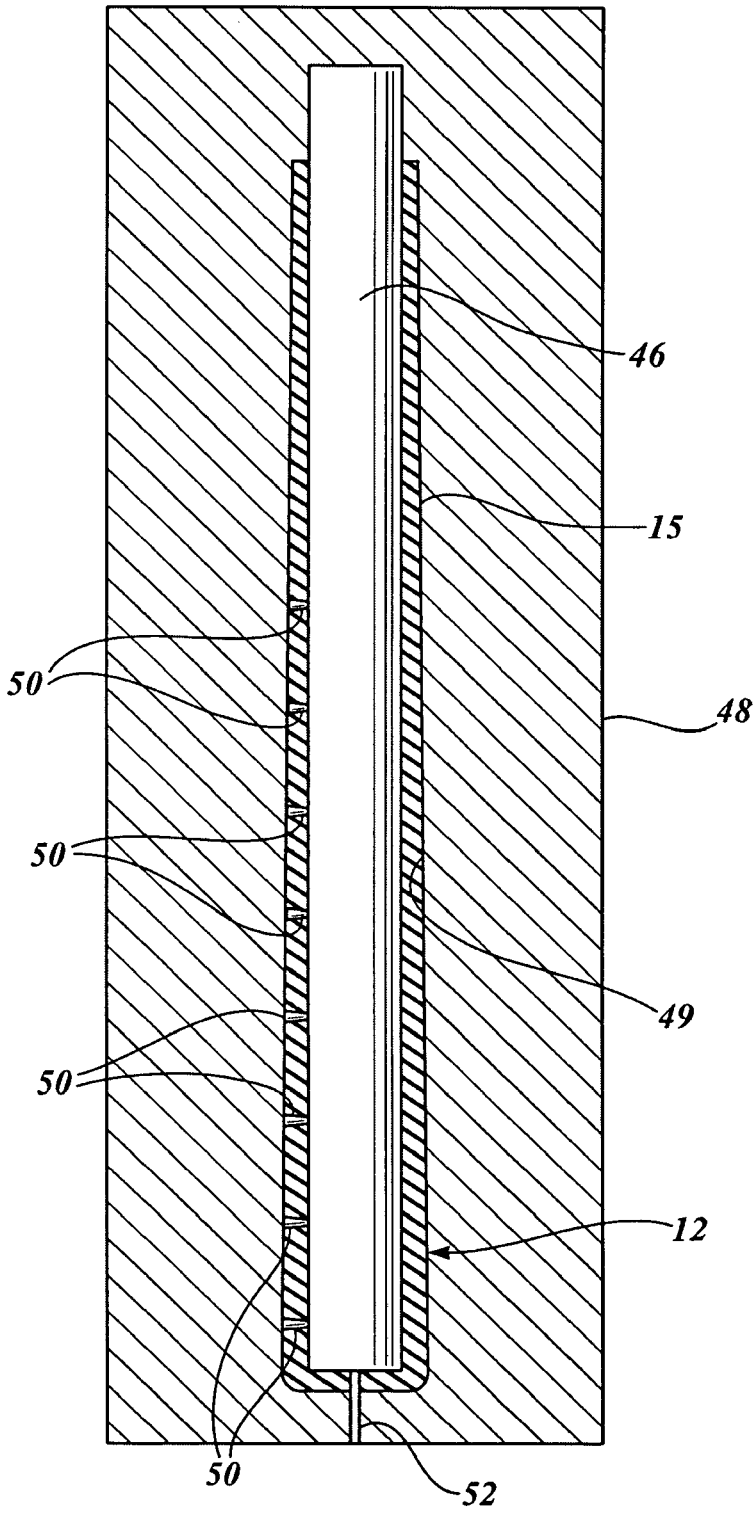
FIG. 5 is a sectional elevational view illustrating the formation of the socket of the golf club grip of FIG. 1.
Figure 6:
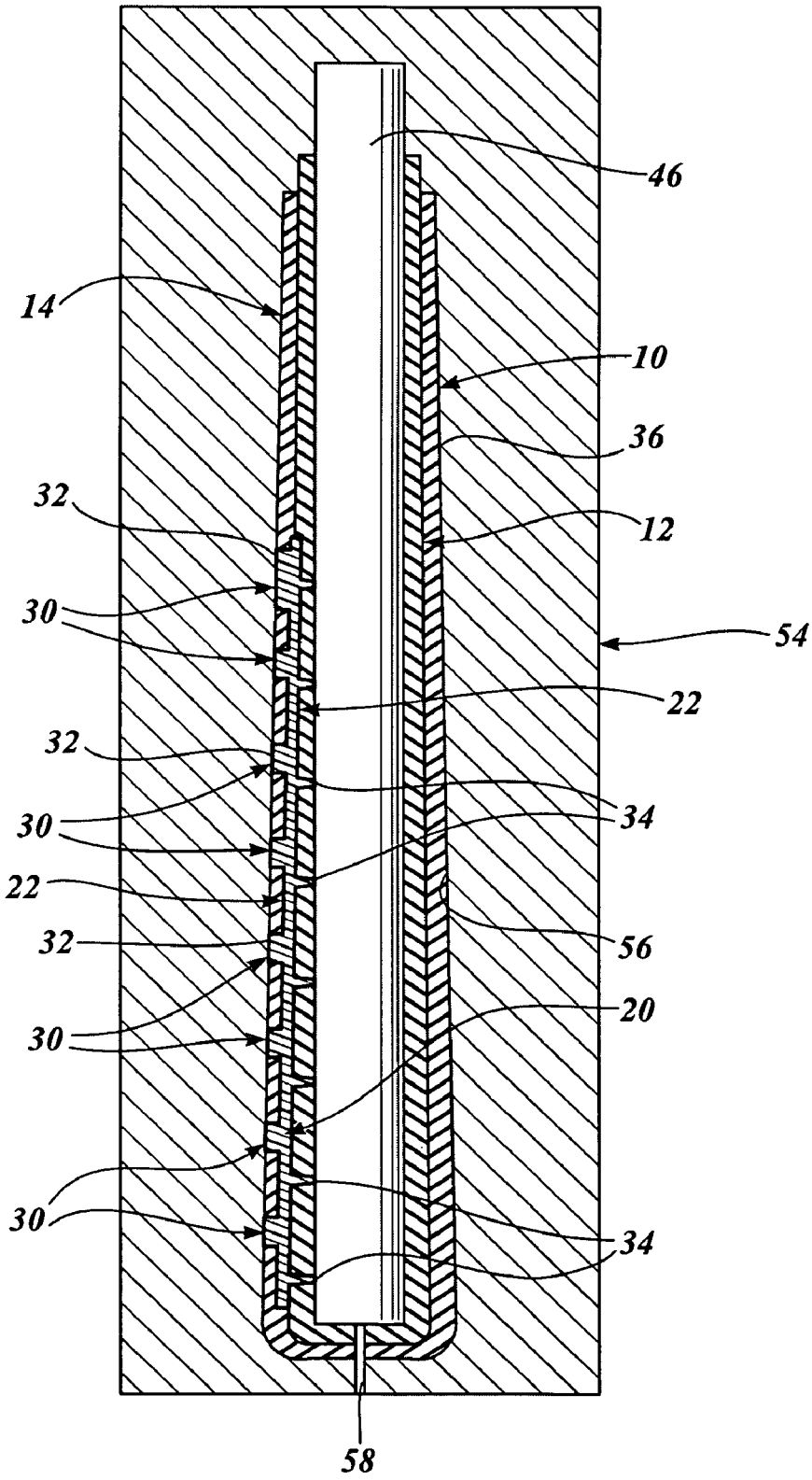
FIG. 6 is a sectional elevational view illustrating the molding of the overlying jacket upon the socket with the placard mounted thereon.

The method of manufacturing the golf club grip 10 is illustrated in FIGS. 5 and 6. Specifically, as shown in FIG. 5, a stainless steel mandrel 46 formed as a rod having the shape of the handle end of a golf club shaft is positioned within a first mold 48. The mold 48 has an inner wall surface 49 with a plurality of tapered positioning pins 50 formed thereon. The positioning pins 50 are directed inwardly toward the mandrel 46. Preferably, the positioning pins 50 are long enough to make contact with the mandrel 46, although contact between the positioning pins 50 and the mandrel 46 is not absolutely necessary.

With the mandrel 46 in position in the first mold 48, a first molten thermoplastic charge, preferably of a thermoplastic rubber, is introduced into the mold 48 through a charge inlet port 52. The first molten charge fills the annular space between the exterior surface of the mandrel 46 and the interior surface of the mold 48 forming the mold cavity until the molten thermoplastic rubber fills the mold cavity, except the portions thereof occupied by the mandrel 46 and the positioning pins 50. The first molten charge is then allowed to cool and solidify. Once solidified, the first molten charge forms the hollow socket 12 illustrated in FIG. 2. When the socket 12 is removed from the first mold 48, the locator apertures 18 are formed through the wall of the socket 12 at longitudinally spaced intervals in a straight line parallel to the axis of the socket 14. The spacing of the locator apertures 18 corresponds to the spacing of the positioning pegs 34 depending from the inside surface 24 of the placard mounting body 22.

The placard 20 is formed as an elongated lattice with generally rectangular flow openings 28 defined therethrough. The plurality of display symbols 30 are molded atop the lattice formed by the mounting base 22. Each of the display symbols 30 resides atop a separate one of the flow openings 28, but does not completely block it.

The placard 20 is mounted upon the socket 12 in the manner illustrated in FIG. 2. That is, the positioning pegs 34 are inserted into the corresponding locator apertures 18 as illustrated in FIGS. 2, 8, and 9. The mandrel 46 having the socket 12 formed thereon, and with the placard 20 mounted upon the socket 12, is then positioned within a second mold 54 having a mold cavity larger than the mold cavity of the first mold 48. The second mold 54 has an inner molding surface, indicated at 56. When the mold components are closed the flat display faces 36 of the raised display characters 30 reside in contact with the inner molding surface 56 of the second mold 54.

A second molten thermoplastic charge is then introduced into the second mold 54 through the injection port 58 thereof. The second molten charge fills portions of the mold cavity of the second mold 54 unoccupied by the mandrel 46, socket 12, and placard 20. An extremely important feature of the molding process is that the molten material of the second molten charge is able to seep in, in between the inner surface 24 of the placard mounting base 22 and the outer surface 15 of the socket 12. The molten material of the second charge thereby flows not only in alongside the side surfaces of the raised symbols 30, but also upwardly and outwardly through the flow apertures 28, and even into the enclosed loops of those symbols having enclosed loops. That is, the molten materials flows up into the triangular space formed within the letter "A", into the enclosed upper and lower loops formed by the top stylized letter "B", and in and around the post 38 and golf club-shaped detail 40 located within the upper and lower loops of the stylized letter "B". The molten material also flows up through the flow openings 28 above and below all of the letters and the registration symbol, and also into the enclosed area within the letter "G" and the partially enclosed areas between the arms of the two letters "E".

Due to the construction of the placard 20, the molten material of the second charge laterally surrounds all of the raised symbols 30 and fills any openings formed therewithin. The molten material also completely covers the upper surface 26 of the placard mounting base 22.

The display surfaces 32 of the display symbols 30, however, reside in contact with the inner molding surface 56 of the second mold 54, as illustrated in FIG. 6. Furthermore, the flow pressure in beneath the undersurface 24 of the placard mounting base 22 tends to force the placard 20 outwardly away from the socket 12, thereby pressing the display faces 32 of the display symbols 30 tightly against the inner molding surface 56 of the second mold 54.

Once the second molten charge solidifies, it forms the jacket 14 which encompasses the socket 12 and encapsulates the mounting base 22 of the placard 20. The solidified structure of the jacket 14 also laterally surrounds all of the displays 30 and fills all open loops therewithin. Each of the display symbols 30 is thereby laterally surrounded by the jacket 14 and all open loops of the display symbols 30 are filled by the solidified structure of the jacket 14. However, all of the display faces 32 of all of the display symbols 30 are exposed at the outer surface of the jacket 14, as illustrated in FIG. 1.

The thermoplastic rubber material of the second charge forming the jacket 14 differs and contrasts in color with the color of the placard 20. As a consequence, the display faces 32 of the display symbols 30 are visible on the outer surface 36 of the jacket 14. Because the socket 12 and jacket 14 are both formed of thermoplastic rubber, and because the placard 20 is also formed as a thermoplastic material, the jacket 14 is molded onto the outer surface of the socket 12 and is physically crosslinked and bonded directly thereto and to the surfaces of contact with the placard 20.

It is to be understood that the particular placard 20 illustrated is only one of any number of different placards that can be mounted interchangeably upon the socket 12 prior to formation of the jacket 14. While each of the interchangeable placards will have at least a plurality of positioning pegs 34 that may be aligned with at least some of the locator openings 18 in the socket wall, the raised displays 30 on each of the interchangeable placards 20 will differ. Golf club grips having the same overall shape as that depicted in FIG. 1 can be produced, but with different display symbols 30 exposed. Accordingly, the use of interchangeable placards 20 to produce a desired display on a golf club grip allows runs of relatively small numbers of different grips for different manufacturers to be produced without changing any of the molding equipment. This is achieved by providing different placards having at least one unique display and/or alternatively mounting a selected one of the placards on each socket as the socket is produced. The same first mold 48 and second mold 54 are employed to form all sockets 12 and jackets 14 having any number of different display features due to the unique design of the placard 20 employed, irrespective of which placard 20 is mounted upon the socket 12.

While the invention has particular utility in fabricating golf club grips, its use is not limited to the fabrication of these implements. The system of the invention may be utilized to form any grip for an implement, such as a handgrip for a motorcycle or bicycle handlebar, a handgrip for a tool, and other types of implement grips, as well. Also, numerous variations and modifications of the invention are possible. For example, instead of forming positioning peg on the inside surface of the placard mounting base for insertion into locator openings in the wall of the socket, an equivalent and opposite construction could be employed. That is, the socket could be formed with outwardly projecting studs and the mounting base of the placard could be formed with corresponding locator openings to receive the studs projecting from the socket. Other variations and modifications of the invention are also possible. Accordingly, the scope of the invention should not be construed as limited to the specific embodiment depicted and implementation of the invention illustrated and described, but rather is defined in the claims appended hereto.

I claim:

1. An implement grip comprising:

a hollow, inner socket having inner and outer surfaces and formed of a thermoplastic material having an open end for receiving a handle of an implement and an opposite end and having a plurality of locating apertures defined in said outer surface, a placard formed with a mounting base having inner and outer surfaces and with flow openings defined therethrough and including at least one raised display projecting from said outer surface, said raised display having an outer face, and further including a plurality of positioning pegs projecting from said inner surface of said mounting base and inserted into said locating apertures in said socket, whereby said placard is mounted on said outer surface of said socket, and a jacket with an outer surface and formed of a thermoplastic material molded upon said socket and encapsulating said mounting base of said placard and laterally surrounding said display, whereby said mounting base is concealed and said display face is exposed at said outer surface of said jacket.

2. An implement grip according to claim 1 configured as a golf club grip in which said socket, said placard, and said jacket are all elongated structures.

3. An implement grip according to claim 1 wherein said mounting base is a stiff, plastic framework and said placard comprising a plurality of displays as aforesaid, at least some of which are configured as raised alpha-numeric characters, all projecting the same distance from said base.

4. An implement grip according to claim 3 wherein at least some of said alpha-numeric characters are formed with laterally enclosing loops.

5. An implement grip according to claim 1 wherein said mounting base is a stiff plastic framework and said placard comprising a plurality of displays as aforesaid, at least some of which are formed with laterally enclosing loops and all of which are raised the same distance from said base.

6. An implement grip according to claim 1 wherein said socket and said jacket are both formed of thermoplastic rubber.

7. A method of manufacturing a grip for an implement comprising:

molding a hollow socket with a plurality of locator apertures thereon on a mandrel in a first mold from a first charge of molten material, mounting a placard upon said socket, wherein said placard is formed with a mounting base having inner and outer surfaces and with flow openings defined therethrough and including at least one raised display projecting from said outer surface of said base and having an outer display face and a plurality of positioning pegs projecting from said inner surface of said base, by inserting said positioning pegs of said placard into said locator apertures of said socket, and molding a jacket about said socket in a second mold from a second charge of molten material, whereby said jacket envelops said socket and said base of said placard and laterally surrounds said display leaving said display face exposed.

8. A method according to claim 7 wherein said second mold has an inner molding surface and said display face is pressed against said inner molding surface of said second mold during molding of said jacket.

9. A method according to claim 7 wherein said placard includes a plurality of said raised displays as aforesaid, and all of said display faces of said displays project the same distance from said base of said placard.

10. A method according to claim 9 further comprising forcing portions of said second charge of material through said flow openings in said mounting base of said placard.

11. A method according to claim 7 wherein said first mold has an interior wall surrounding a mold cavity, and positioning pins project into said mold cavity from said interior wall of said first mold to form said locator apertures in said socket.

12. A method according to claim 7 wherein said placard is formed with a plurality of raised displays as aforesaid, all projecting a uniform distance from said base and said second mold has an inner mold surface, whereby said second charge of molten material concurrently presses said display faces of said raised displays against said inner mold surface of said second mold during molding of said jacket.

13. A method according to claim 7 wherein both said first and second charges are formed of thermoplastic materials.

14. A method according to claim 13 wherein both said first and second charges are formed of thermoplastic rubber.

15. A method according to claim 7 further comprising forming a plurality of different placards as aforesaid, each having at least one unique display as aforesaid, and alternatively mounting a selected one of said placards on said socket, and utilizing said same first and second molds to form said socket and said jacket, irrespective of which placard is mounted upon said socket.

16. A method of fabricating a sporting implement grip comprising:

positioning a mandrel within a first mold having a mold cavity with an inner wall that has a plurality of positioning pins directed toward said first mandrel, introducing a first molten thermoplastic charge into said first mold and allowing said first charge to solidify to form a hollow socket having an outer surface with locator apertures therein formed by said positioning pins, mounting upon said socket a placard formed with a mounting base having inner and outer surfaces and with flow openings defined therethrough and said placard includes at least one raised display projecting from its outer surface, wherein said display has a display face, and further including a plurality of positioning pegs projecting from said inner surface of said mounting base, by inserting said positioning pegs into said locator apertures, positioning said mandrel with said socket and said placard thereon within a second mold having a mold cavity larger than that of said first mold and having an inner molding surface with said display face residing in contact with said inner molding surface of said second mold, and introducing a second molten thermoplastic charge into said second mold and allowing said second charge to solidify to form a jacket with an outer surface molded upon said socket and encapsulating said mounting base of said placard and laterally surrounding said display, whereby said mounting base is concealed and said display is laterally surrounded by said jacket and said display face is exposed at said outer surface of said jacket.

17. A method according to claim 16 further characterized in that said placard has a plurality of raised displays as aforesaid, all projecting a uniform distance out from said base, and said second mold has an inner molding surface, and further comprising concurrently pressing all of said display faces against said inner molding surface of said second mold while introducing said second molten charge into said second mold.

18. A method according to claim 16 wherein said first and second charges are both thermoplastic materials.

19. A method according to claim 18 wherein said first and second charges are each comprised of a thermoplastic rubber.

20. A method according to claim 16 further comprising forming said base of said placard as an elongated lattice with said flow openings defined therethrough, and a plurality of displays as aforesaid are molded atop said lattice, each of said displays residing atop a separate one of said flow openings.

* * * * *